United States Patent [19]

Freese et al.

[11] 4,221,268

[45] Sep. 9, 1980

[54] SLIDE RAIL ASSEMBLY FOR A WORK VEHICLE

[75] Inventors: Gary P. Freese, Joliet; Robert J. Trayler, Braidwood, both of Ill.

[73] Assignee: Caterpillar Tractor Co., Peoria, Ill.

[21] Appl. No.: 14,018

[22] PCT Filed: Dec. 21, 1978

[86] PCT No.: PCT/US78/00250

§ 371 Date: Dec. 21, 1978

§ 102(e) Date: Dec. 21, 1978

[87] PCT Pub. No.: WO80/01296

PCT Pub. Date: Jun. 26, 1980

[51] Int. Cl.[3] ..... E02F 3/76

[52] U.S. Cl. ..... 172/805; 403/108

[58] Field of Search ..... 172/801, 802, 803, 804, 172/805, 806, 807, 809; 403/108, 328, 324, 316, 322

[56] References Cited

U.S. PATENT DOCUMENTS

| | | | |
|---|---|---|---|
| 2,788,731 | 4/1957 | Lindren | 172/236 |
| 3,386,519 | 6/1968 | Long | 172/805 |
| 3,400,767 | 9/1968 | Hermiz | 172/805 |
| 3,628,612 | 12/1971 | Liess | 172/804 |
| 3,662,838 | 5/1972 | Polzin | 172/804 |
| 3,674,096 | 7/1972 | Berg | 172/805 |
| 3,749,182 | 7/1973 | Rockwell | 172/804 |
| 4,021,126 | 5/1977 | Deeter | 403/322 |
| 4,035,096 | 7/1977 | Miller | 403/322 |

*Primary Examiner*—Richard J. Johnson

*Attorney, Agent, or Firm*—William B. Heming

[57] ABSTRACT

A slide rail assembly (18) and slide plate (20) are used, for example, to position an implement (14) of a work vehicle (10), such as a bulldozer (14), at various angles. The bulldozer connected slide plate (20) moves along a vehicle connected rail (22) of the rail assembly (18) to a desired position of the bulldozer (14). A pin (60) is positioned through aligned openings (48,62) in the rail (22) and slide plate (20) to maintain the position. The pin (60) or rail (22) can sometimes fail owing to working loads exerted on the bulldozer (14). A plurality of bushings (50) are each positioned in a respective rail opening (48) and maintained substantially fixed in order to increase bearing support area of the pin (60) and to strengthen the rail assembly (18).

9 Claims, 4 Drawing Figures

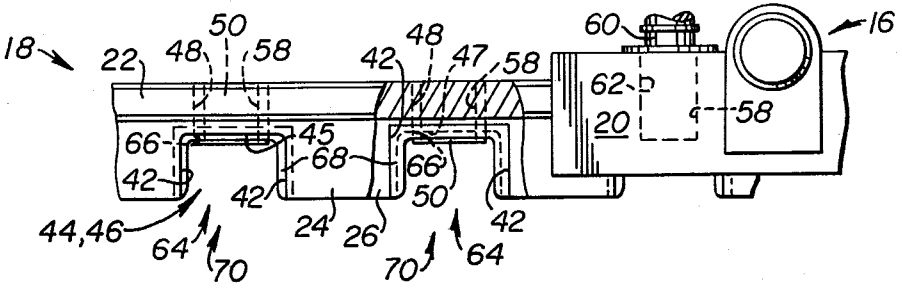
FIG. 2.
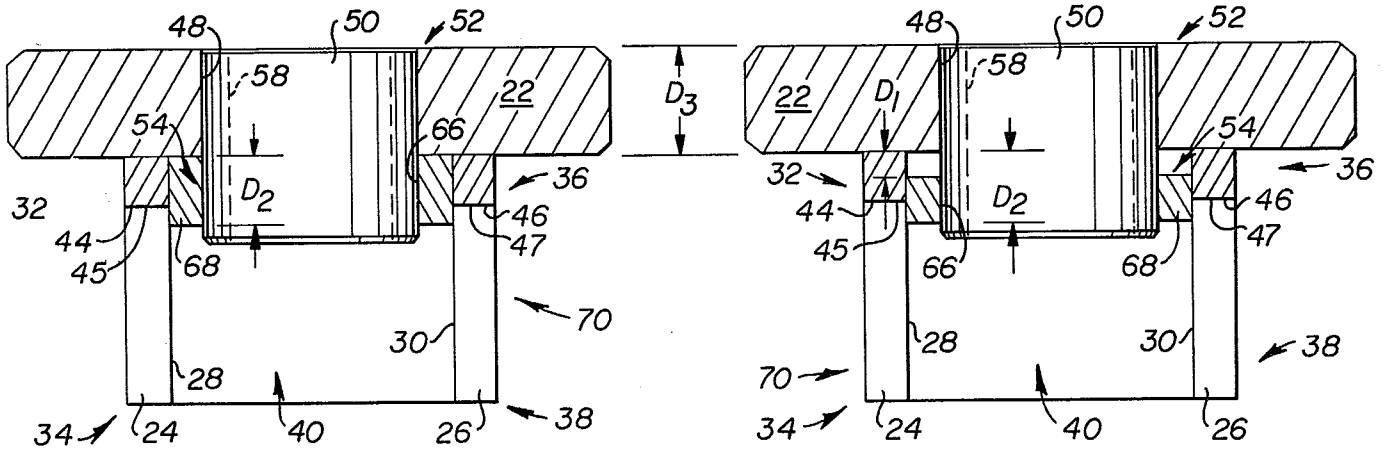
FIG. 3.
FIG. 4.

SLIDE RAIL ASSEMBLY FOR A WORK VEHICLE

DESCRIPTION

1. Technical Field

The invention relates to a slide rail assembly such as is used on a slider mechanism of a work vehicle to position an implement at desired angles relative to the vehicle.

2. Background Art

In the use of a slider mechanism for angling an implement of a work vehicle, it is desirable to prevent damage or failure of the slider mechanism owing to loads exerted on the slider mechanism through the implement.

U.S. Pat. No. 3,662,838 which issued on May 16, 1972, to Polzin et al, shows an embodiment of a slider mechanism associated with a C-frame mounted tractor blade. A slide plate or U-shaped base member is positioned about and slides along guide rails connected to an arm of the C-frame to angle the blade. A pin passes through openings in the slide plate, guide rails and C-frame arm to lock the blade in a desired position. U.S. Pat. No. 3,674,096 which issued to Berg on July 4, 1972 shows a similar embodiment of a power slider mechanism.

U.S. Pat. No. 3,628,612 which issued to Liess on Dec. 21, 1971, shows an embodiment of a slider mechanism associated with a power angling tractor blade. A slide plate or guide member is positioned about and slides along a rail to position the blade. The rail is connected to the C-frame of the blade by a U-shaped leg. U.S. Pat. No. 3,386,519 which issued to Long on June 4, 1968, and U.S. Pat. No. 3,749,182 which issued to Rockwell on July 31, 1973, show embodiments of slider mechanisms having T-shaped rails about which slide plates are positioned.

For example, a bulldozer of a track-type tractor is generally movable to various angles relative to a longitudinal axis of the vehicle for adjusting the bulldozer to different work operations. In adjusting the bulldozer, a slider mechanism having a slide rail assembly and a slide plate is commonly used. The slide rail assembly is connected to an arm of a C-frame centrally supporting the bulldozer relative to the tractor. The slide plate is connected to the edge of the bulldozer through a positioning arm and moves along the slide rail assembly. Thus, moving the slide plate relative to the slide rail assembly pivots or angles the edge of the bulldozer about its central connection with the C-frame. Tractors generally have two such slider mechanisms associated with opposite arms of the C-frame. The slide plates of each arm move opposite one another relative to the fixed slide rail assemblies when angling the bulldozer.

In one configuration of a slide rail assembly, first and second spaced apart legs are attached to a rail and to an arm of the C-frame. The slide plate slides along the rail to position an opening in the slide plate in register with one of a plurality of openings in the rail for determining a position of the bulldozer. A pin is placed in said openings to secure the bulldozer in the desired position.

Because of high loading on the pin and rail exerted through the slide plate owing to forces on the bulldozer, the pin or rail can deform or fail during operation of the tractor. This represents a waste of time and labor to replace the pin or rail on the tractor. Also, lateral openings are positioned in the legs adjacent the rail openings to relieve material such as dirt or mud packed between the legs and in the rail openings. Said openings can sometimes promote failure during loading owing to a weakening of the rail section at that point.

Therefore, it is desirable to increase the bearing area provided by the rail openings to support the pins and to strengthen the slide rail assembly in the areas adjacent the rail openings.

DISCLOSURE OF INVENTION

In one aspect of the present invention, a slide rail assembly has a rail and first and second spaced apart legs connected to the rail and defining a channel with said rail between the legs. The rail has a plurality of openings passing through said rail. The legs each have a plurality of relief openings. The slide rail assembly has a plurality of bushings each having first and second end portions. The first end portions are each positioned in a respective one of the openings in the rail. The second end portions each extend downwardly into the channel. Means is provided for maintaining each of said second end portions of the bushings substantially fixed relative to the rail and the legs.

The slide rail assembly is used with a slide plate to position, for example, an implement of a work vehicle, such as a bulldozer. A bulldozer connected slide plate moves along the rail to a desired position of the bulldozer. A pin is then positioned in an opening of the slide plate and one of the openings in the rail to maintain the desired position. Failure of the pin or rail can sometimes occur owing to loads exerted on the bulldozer which are passed through the slide plate. The supported bushings increase the bearing support area for the pin for substantially eliminating pin and rail failure.

BRIEF DESCRIPTION OF DRAWINGS

FIG. 2 is a partial diagrammatic view taken along line II—II of FIG. 1;

FIG. 3 is a diagrammatic cross-sectional view taken along lines III—III of FIG. 1; and FIG. 4 is a diagrammatic cross-sectional view showing another embodiment of the invention.

BEST MODE FOR CARRYING OUT THE INVENTION

Figure 1:
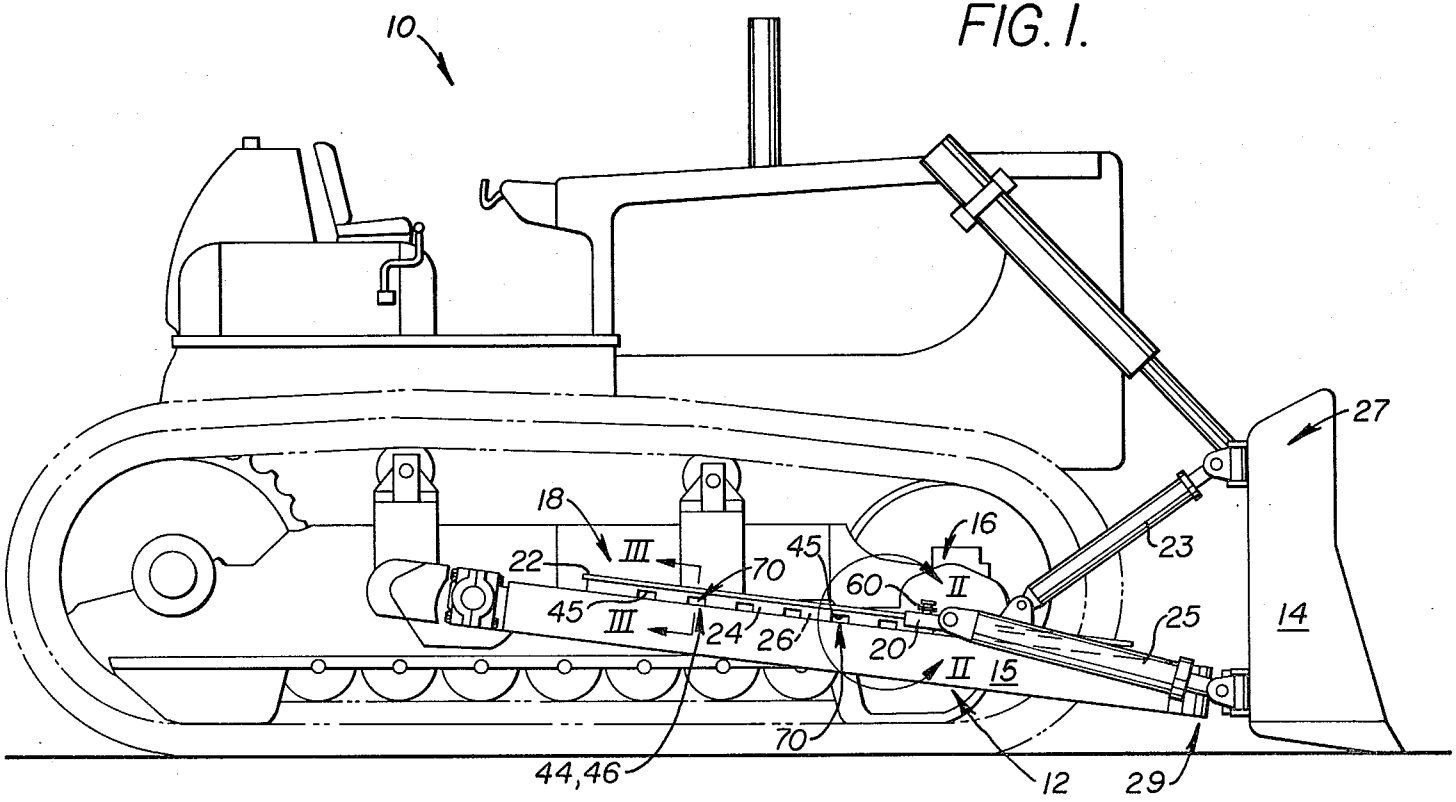
FIG. 1 is a diagrammatic side view of a work vehicle showing one embodiment of the present invention.

Referring particularly to FIG. 1, a work vehicle 10 has a frame 12 and an implement 14. The work vehicle 10 is shown, for example, as a track-type tractor 10 with the frame 12 and implement 14 being a C-frame 12 and bulldozer 14, respectively. The C-frame 12 has two arms 15 each of which is pivotally connected to the tractor 10 and associated with a respective slider mechanism 16. For convenience, only one of the arms 15 and the related slider mechanism 16, as is shown, will be discussed. The other arm and associated slider mechanism are associated with the opposite side of the tractor 10 and are of similar configurations.

The slider mechanism 16 includes a slide rail assembly 18 and a slide plate 20. The slide rail assembly 18 has a rail 22 and first and second spaced apart legs 24,26, as is best seen in FIGS. 3 and 4. Each of the legs 24,26 is connected to and positioned along the rail 22 and is also connected to the C-frame arm 15. The slide plate 20, as will be hereinafter more fully discussed, is positioned on and about the rail 22 and is slidably movable relative to said rail 22. The bulldozer 14, which is pivotally connected at one end 27 to the slide plate 20 by first and second control arms 23,25 and to a forward portion 29 of the C-frame 14, is thus movable to preselected positions at different angles relative to the tractor 10 in response to slidably moving the slide plate 20 relative to the rail 22 and C-frame 15.

The legs 24,26 of the slide rail assembly 18 each have an inner surface 28,30 and first and second ends 32,34;36,38 (FIGS. 3 and 4). Said legs 24,26 are connected at the first ends 32,34 to the rail 22 and define a channel 40 with said rail 22 between said legs 24,26. The legs 24,26 also each have a plurality of edge wall portions 42 (FIG. 2) and relief openings 44,46, each having a periphery 45,47. Said openings 44,46 can be, for example, positioned in the legs 24,26 as shown or defined by individual segments of the legs 24,26. The relief openings 44,46 shown are of a "U" configuration each opening on the second end 34,38 of the related one of the legs 24,26. Each of the edge wall portions 42 defines a portion of a respective periphery 45,47 of one of the relief openings 44,46. The rail 22 has a plurality of openings 48 passing through said rail 22 and into communication with the channel 40. The openings 44 of the first leg 32 are each positioned adjacent a respective one of said openings 48 of the rail 22. Said openings 44 are each generally in alignment with a respective one of the openings 46 of the second leg 34 across the channel 40. Such implement 14 and slider mechanism 16 construction is well known in the earthmoving art and is commonly used to provide both manual and power angling of a tractor implement.

The slide rail assembly 18 has a plurality of bushings 50 each having first and second end portions 52,54. The first end portions 52 are each positioned in a respective one of the openings 48 in the rail 22. The second end portions 54 each extend downwardly into the channel 40 between the legs 24,26. Means 56 is provided for maintaining each of the second end portions 54 of the bushings 50 substantially fixed relative to the rail 22. The bushings 50 each have an internal opening 58 of a size sufficient for receiving a pin 60 which is removably positionable in an opening 62 of the slide plate 20 and one of the bushing openings 58 to secure said slide plate 20 at a desired position relative to the rail 22. The openings 44,46 on the legs 24,26 are provided for relieving packed material, such as mud, from said bushing openings 58 and from between the rails 22 adjacent said openings 48.

Said means 56 includes a brace assembly 64 connected to the slide rail assembly 18. The brace assembly 64 has a plurality of openings 66 each in register with a respective one of the openings 48 in the rail 22. The second end portions 54 of said bushings 50 are each positioned in the respective one of the openings 66 in said brace assembly 64 in register with the related one of the openings 48 in the rail 22.

In the preferred embodiment, the brace assembly 64 includes a plurality of brace elements 68 each having a respective one of the openings 66 of the brace assembly 64. The brace elements 68 extend between and are connected by welds or the like to the first and second legs 24,26. Each of the brace elements 68 is positioned immediately adjacent the edge wall portion 42 of the related one of the rail openings 48 and preferably extend substantially about the peripheries 45,47 of both the related aligned relief openings 44,46 in the legs 24,26. It is desirable that said brace elements 68 be positioned a preselected distance $D_1$ from the rail 22, as is shown in FIG. 3. The brace elements 68 can also be positioned in contact with and connected to the rail 22 (FIG. 4).

It is desirable that the brace elements 68 each be of a "U" configuration and each be positioned in alignment with the related respective pair of aligned U-shaped relief openings 44,46 in the first and second legs 24,26. Thus, where the brace elements 68 extend substantially about the peripheries 45,47 of the related pair of relief openings 44,46 a channel 70 is defined with the arm 15 of the C-frame 12 to effectively provide relief of material packed into the bushings 50 and between the legs 24,26 in said channel 70.

It should be understood that the slider mechanism 16 can be of other configurations as is known in the art without departing from the invention.

INDUSTRIAL APPLICABILITY

In the use of the slide rail assembly 18, the slide plate 20 is moved along the rail 22 to position the bulldozer 14 at a desired angle relative to the tractor 10. The pin 60 is inserted into the opening 62 in the slide plate 20 and the one of the openings 58 of the bushings 50 in register with the slide plate opening 62 to secure the bulldozer 14 in the desired position.

An additional distance $D_2$, which the pin 60 extends into the bushing openings 58 relative to a distance $D_3$ represented by the width of the rail 22, represents a proportionate increase in the bearing area of the slide rail assembly 18 for holding the pin 60. The extra bearing area provides increased resistance of the pin 60 to axial loads applied on said pin 60 from the bulldozer 14 through the slide plate 20 and rail 22. The result is to substantially maintain the pin 60 against bending. The brace elements 68 also reinforce the portion of the slide rail assembly 10 adjacent the rail openings 48 in order to substantially maintain the rail 22 from yielding under work loads on the bulldozer 14.

It is desirable that the bushings 50 have a material hardness greater than the material hardness of the legs 24,26 and the rail 22 for further strengthening of the pin bearing area. The configuration of the present invention permits, for example, bushings, which are heat treated separately from the rail 22 and legs 24,26, to be assembled on the slide rail assembly 18. The result is an increased tendency of the pin 60 and rail 22 to resist yielding under the tractor work loads. The bushings 50 may be welded into position, for example, or pressed into an interference fit with the rail openings 48 for permitting replacement of damaged or worn bushings 50.

Other aspects, objects and advantages will become apparent from a study of the specification, drawings and appended claims.

We claim:

1. In a slide rail assembly (18) having a rail (22) and first and second spaced apart legs (24,26), said legs (24,26) each having first and second ends (32,34;36,38) and a plurality of relief openings (44,46) and each being connected at their respective first ends (32,36) to and positioned along said rail (22) and defining a channel (40) with said rail (22) between the legs (24,26), said rail (22) having a plurality of openings (48) passing through said rail (22) and into communication with said channel (40), said relief openings (44) of the first leg (24) each being generally in alignment with a respective one of the relief openings (46) of said second leg (26) across the channel (40) and each being positioned adjacent a respective one of said openings (48) of the rail (22), the improvement comprising:

a plurality of brace elements (68) each having an opening (66) and each being connected to and extending between said first and second legs (24,26), said openings (66) in the brace elements (68) each being in register with a respective one of the openings (48) in the rail (22);

a plurality of bushings (50) each having first and second end portions (52,54), said first end portions (52) each being positioned in a respective one of the openings (48) in the rail (22), said second end portions (54) each extending downwardly into the channel (40) between the legs (24,26) and each being positioned in the respective one of the openings (66) in said brace elements (68) in register with the related respective one of the openings (48) in the rail (22); and said relief openings (44,46) of the first and second legs (24,26) each being of a "U" configuration opening on the second end (34,38) of the related one of the legs (24,26).

2. The slide rail assembly (18), as set forth in claim 1, wherein said relief openings (44,46) of the first and second legs (24,26) each have a periphery (45,47), the first and second legs (24,26) each have a plurality of edge wall portions (42) each defining a respective periphery (45,47) of one of the related relief openings (44,46) and each of the brace elements (68) is positioned immediately adjacent the edge wall portion (42) of the related one of the relief openings (44,46).

3. The slide rail assembly (18), as set forth in claim 4, wherein the brace elements (68) each extend substantially about the peripheries (45,47) of both the related generally aligned relief openings (44,46).

4. The slide rail assembly (18), as set forth in claim 1, wherein said brace elements (68) are each of a "U" configuration and are each positioned in alignment with the related respective pair of aligned U-shaped relief openings (44,46) of the first and second legs (24,26).

5. The slide rail assembly, as set forth in claim 1, wherein said brace elements (68) are each positioned a preselected distance ($D_1$) from the rail (22).

6. The slide rail assembly (18), as set forth in claim 1, wherein said brace elements (64) are each positioned in contact with the rail (22).

7. The slide rail assembly (18), as set forth in claim 1, wherein said bushings (50) have a material hardness greater than material hardness of the legs (24,26) and the rail (22).

8. A work vehicle (10), comprising:

a frame (12) pivotally connected to said work vehicle (10);

a rail (22) having a plurality of openings (48) passing through said rail (22);

first and second spaced apart legs (24,26) each having first and second ends (32,34;36,38) and a plurality of relief openings (44,46) and each being connected at their respective first ends (32;36) to and positioned along said rail (22) and at their respective second ends (34;38) to said frame (12) and defining a channel (40) with said rail (22) between the legs (24,26), said channel (40) being in communication with said openings (48) in the rail (22), each of said relief openings being of a "U" configuration opening on the second end (34,38) of the related one of the legs (24,26), said relief openings (44) of the first leg (24) each being generally in alignment with a respective one of the relief openings (46) of said second leg (26) across the channel (40) and being positioned adjacent a respective one of said openings (48) of the rail (22);

a brace assembly (64) having a plurality of openings (66) and being connected to and extending between the first and second legs (24,26); said openings (66) in the brace assembly (64) each being in register with a respective one of the openings (48) in the rail (22); and a plurality of bushings (50) each having first and second end portions (52,54), said first end portions (52) each being positioned in a respective one of the openings (48) in the rail (22), said second end portions (54) each extending downwardly into the channel (40) between the legs (24,26) and each being positioned in the respective one of the openings (66) in said brace assembly (64) in register with the related respective one of the openings (48) in the rail (22).

9. The slide rail assembly (18), as set forth in claim 8, wherein said brace assembly (64) has a plurality of brace elements (68) each having a respective one of the openings (66) of said brace assembly (64) and each being connected to and extending between said first and second legs (24,26).

* * * * *